United States Patent [19]

Gresham, Jr.

[11] 4,108,586

[45] Aug. 22, 1978

[54] APPARATUS FOR FORMING IRREGULAR SHAPED BRICK

[75] Inventor: Lucius C. Gresham, Jr., Henderson, Tex.

[73] Assignee: Henderson Clay Products, Inc., Henderson, Tex.

[21] Appl. No.: 828,966

[22] Filed: Aug. 29, 1977

Related U.S. Application Data

[62] Division of Ser. No. 683,803, May 6, 1976, Pat. No. 4,078,038.

[51] Int. Cl.[2] ..... B28B 3/12

[52] U.S. Cl. ..... 425/89; 425/370; 425/385

[58] Field of Search ..... 425/89, 219, 220, 385, 425/373, 370; 264/293

[56] References Cited

U.S. PATENT DOCUMENTS

| | | | |
|---|---|---|---|
| 1,411,533 | 4/1922 | Straight | 425/385 |
| 1,411,535 | 4/1922 | Straight | 425/385 |
| 3,910,711 | 10/1975 | Moorhead | 264/316 |

*Primary Examiner*—Francis S. Husar
*Assistant Examiner*—John McQuade
*Attorney, Agent, or Firm*—Mason, Fenwick & Lawrence

[57] ABSTRACT

A horizontal brick feed conveyor continuously feeds green undried moist clay bricks along a path beneath a lower horizontal flight of an elastic hold-down belt member mounted above and moving in the same direction as the conveyor to engage the upper surface of the conveyed brick; a relatively large motor-driven irregularly spaced impression roller is adjustably mounted adjacent the upper surface of the horizontal flight of the hold-down belt to engage the horizontal flight so that a number of protrusions on the roller deflect portions of the elastic hold-down belt downwardly into the green brick immediately beneath the hold-down belt so that the bricks are distorted and misshaped to give an antique or handmade effect.

7 Claims, 6 Drawing Figures

10
12
14
14'
16
17
18
20
21
22
24
25
26
27
29
30
30'
31
32
33
34
35
36
38
40
42
43
44
45
46
46'
48
50
52
4

APPARATUS FOR FORMING IRREGULAR SHAPED BRICK

This is a division of application Ser. No. 683,803 filed May 6, 1976 and now issued as U.S. Pat. No. 4,078,038.

BACKGROUND OF THE INVENTION

This invention is in the field of brick manufacture and is specifically directed to apparatus for rapidly forming bricks of irregular configuration having an antique or handmade appearance.

The brick making industry is highly developed and employs a substantial amount of automation for extruding, cutting and forming conventional rectangular bricks and the like having a geometrically uniform rectangular parallelpiped configuration in which the sides of the brick are planar with adjacent sides being perpendicular to each other. Equipment for producing the geometrically uniform bricks of the foregoing type includes automatic brick handling means for removing bricks from conveyor means which handling means requires that the individual bricks be equidistantly spaced in a proper geometric array on the conveyor in order for the handling equipment to function properly. Used or antique brick have become extremely popular in recent years and those of skill in the art have been unable to provide satisfactory equipment for the automatic manufacture of bricks having irregular surfaces with one of the main problems being due to the fact that prior known equipment for providing brick with irregular surfaces has been incompatible with the automatic brick handling equipment so as to consequently entail substantial manual labor and resultant expense. For example, irregular shaped brick members have been formed by taking conventional rectangular green brick formed of wet clay and dropping the brick from a height of approximately three or four feet so that the bricks are bent and deformed. However, deformation of brick in the foregoing manner results in the brick being in random array which cannot be handled by downstream automatic handling equipment unless the brick are manually aligned on a conveyor at a substantial cost in time and labor. Moreover, the forming of irregular brick in the foregoing manner results in substantial breakage and waste which further adds to the overall expense of the process.

Another disadvantage of the tumbling or dropping process is that many of the brick are deformed on all surfaces so that they do not have any truly planar surfaces and are substantially more difficult to process and lay than are brick having at least one planar surface.

Other approaches have included the use of embossing rollers or the like engaging the surface of the brick members as they are conveyed past the roller. Unfortunately, devices of the foregoing type frequently knock the brick over and destroy any previously existing uniform geometric array of the brick on the conveyor so that substantial manual labor is required for repositioning the brick in the position necessary for the brick to be subsequently handled by the automatic handling equipment.

Therefore, it is the primary object of this invention to provide a new and improved apparatus for fabricating brick of irregular configuration.

A further object of the invention is the provision of a new and improved apparatus for fabricating brick having generally irregular configuration but having one true planar surface.

Yet another object of the invention is the provision of a new and improved apparatus for fabricating bricks having an antique appearance.

SUMMARY OF THE INVENTION

Achievement of the foregoing objects of the invention is enabled by the preferred embodiment of the invention in which a horizontal brick feed belt conveyor provides a supply of green moist clay bricks which have just been previously cut from an extruded column of wet clay in a conventional manner. The bricks are spaced and aligned on the moving conveyor and an elastic hold-down member is mounted above the brick conveyor with a lower flight of the hold-down belt extending substantially parallel to the brick feed belt and positioned to engage the upper surface of the brick members as they are moved along a horizontal feed path by the brick conveyor. The lower flight of the hold-down belt is driven in the same direction as the brick on the conveyor and a relatively large irregularly surfaced impression roller is mounted adjacent to and engaging the upper surface of the lower flight of the hold-down belt. The impression roller has a number of protrusions which deflect portions of the elastic hold-down belt downwardly into the green brick immediately beneath the hold-down belt so that the green bricks are distorted and deformed to provide an irregular configuration. The distorting action of the protrusions on the impression roller causes the mortar faces of the brick to bulge inwardly and outwardly as well as the end faces in many instances so that the brick has an irregular configuration on all faces with the exception of the lower face which rests on the brick conveyor. The hold-down belt prevents the brick members from being knocked over by the operation of the impression roller and insures that the brick members remain in their desired geometric position on the conveyor so that they can be removed from the conveyor at a location downstream of the deforming station by conventional automatic brick handling equipment.

In one embodiment of the invention, the hold-down belt is driven by an electric variable speed motor drive system which can be adjusted to insure that the hold-down belt is operated at exactly the same speed as the brick conveyor belt. In another manner of operation, when the brick members are of such configuration as to have a large base portion resting on the brick conveyor, it is not necessary for the hold-down belt to be driven since the frictional engagement of the upper surface of the brick members provides a sufficient force on the belt to provide the necessary belt movement.

A better understanding of the manner in which the preferred embodiment achieves the objects of the invention will be enabled when the following written description is considered in conjunction with the appended drawings in which like reference numerals are used for the same parts in the different figures as described hereinafter.

DESCRIPTION OF THE PREFERRED EMBODIMENT

Figure 1:
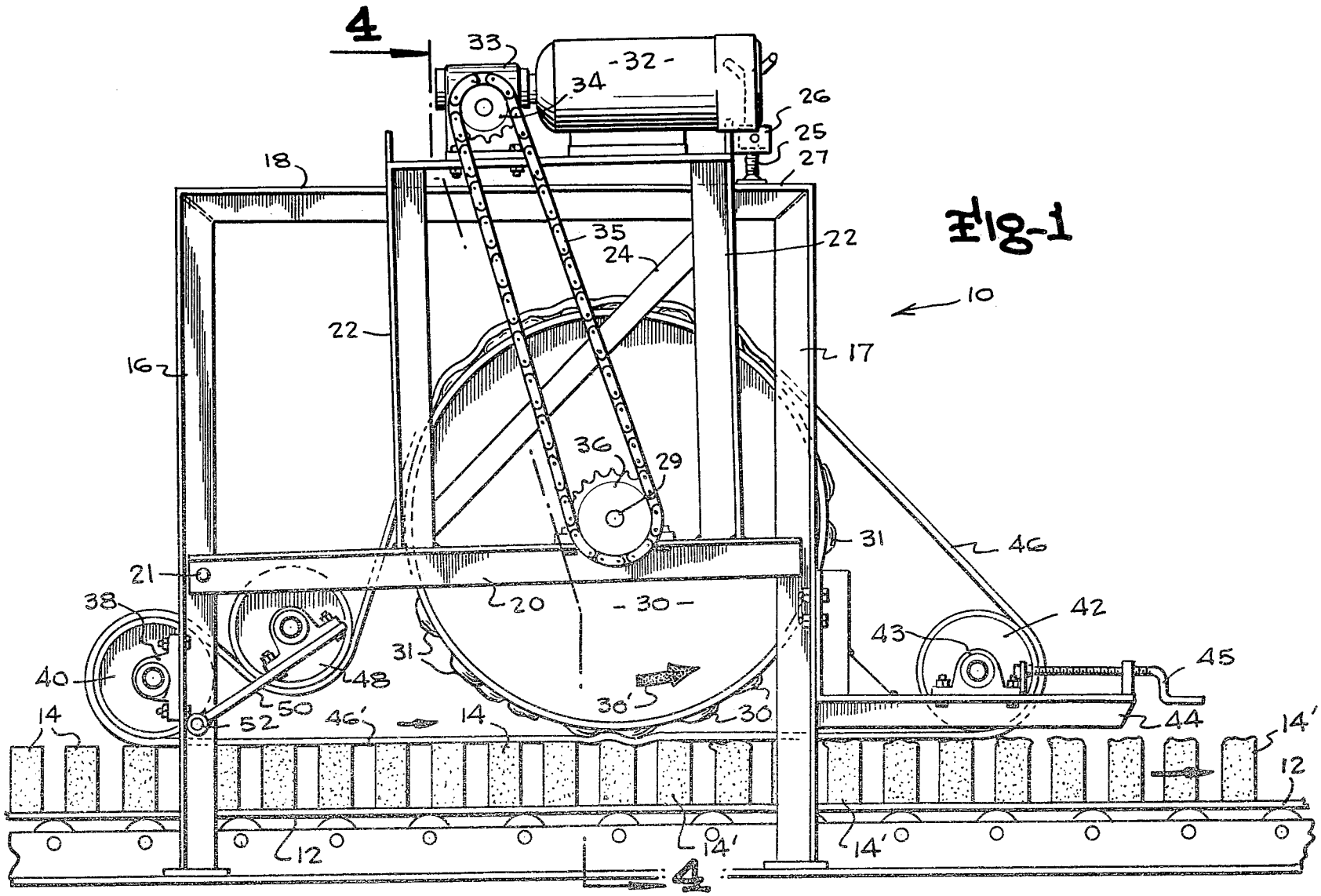
FIG. 1 is a side elevation view of the preferred embodiment for practice of the invention.
Figure 6:
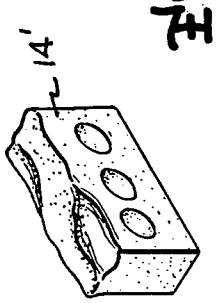
FIG. 6 is a perspective view illustrating a typical irregularly surfaced finished brick produced by the invention.
Figure 5:
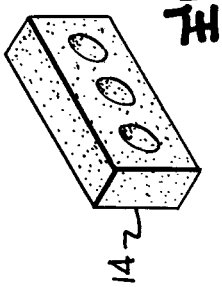
FIG. 5 is a perspective view of a green brick of the type used in the inventive apparatus in practice of the invention.
Figure 2:
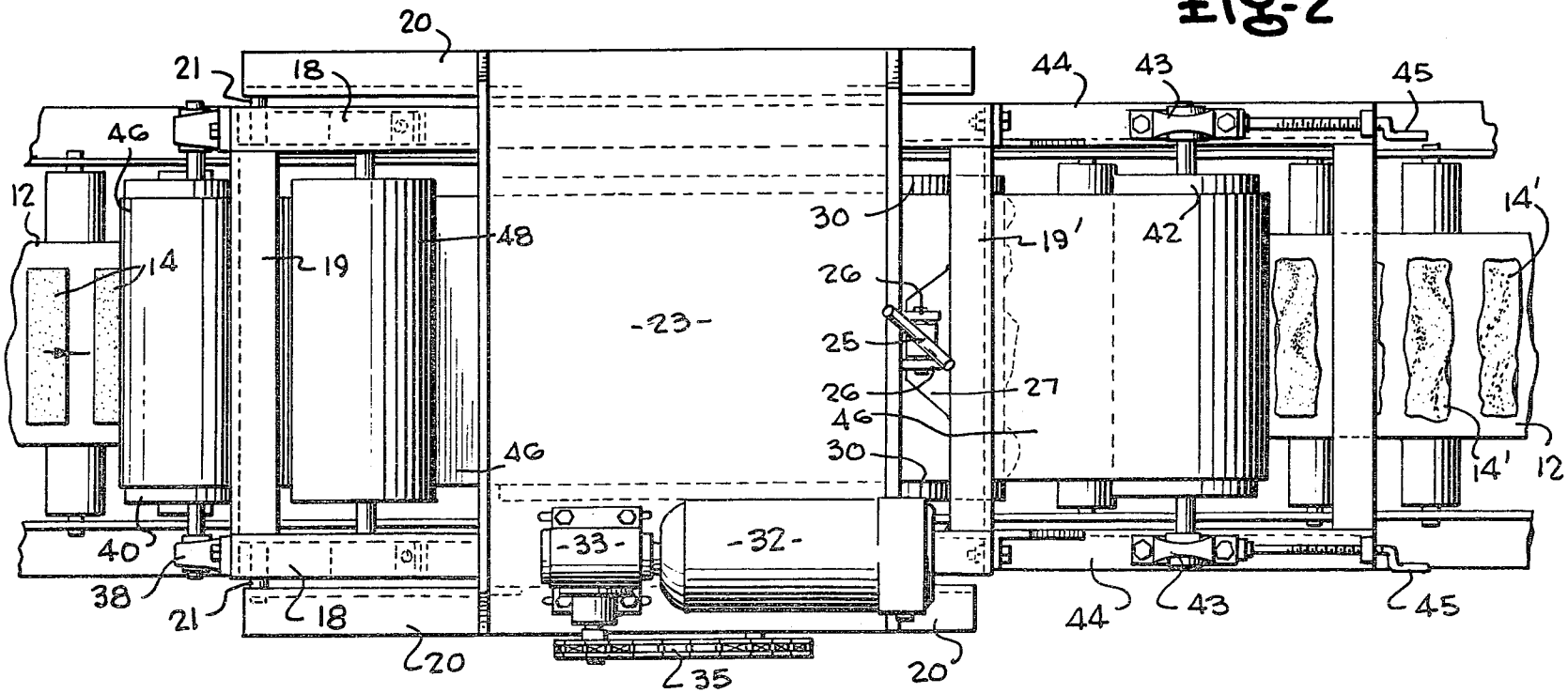
FIG. 2 is a top plan view of the preferred embodiment.

Attention is initially invited to FIG. 1 which illustrates the preferred embodiment for practice of the invention which is generally designated 10 and which includes a generally horizontal brick conveyor 12 moving from left to right in FIG. 1 at a constant speed on which spaced and aligned conventional green uncured bricks 14 of rectangular parallelpiped configuration are positioned. The green uncured bricks 14 are formed in a conventional manner from a mixture of clay and water extruded from conventional extrusion means in a solid column that is subsequently cut into the individual brick members which are then separated to provide an approximate equidistant spacing of the green brick on conveyor 12 as illustrated in FIG. 1. Since the production of the individual green brick members 14 is in a completely conventional manner, it is not illustrated.

A vertically extending fixed frame including upstream vertical corner post members 16, downstream vertical corner post members 17 longitudinal top members 18 and transverse top members 19 and 19' are positioned over conveyor belt 12 for providing support for an adjustable frame carrying brick engaging means which forcefully presses downwardly on the green brick 14 to distort the brick to provide an irregularly shaped brick 14' having an antique or handmade appearance. The adjustable frame includes front and rear pivot arms 20 pivotally connected by pivot means 21 to the upstream vertical corner post members 16 with other components of the adjustable frame including approximately vertical members 22 which are joined at their upper ends by a motor support plate 23 with diagonal braces 24 being welded between vertical members 22 to provide a rigid adjustable frame structure pivotally adjustable about the axis of pivot means 21.

A threaded adjustment rod 25 is carried by bracket means 26 on the adjustable frame and has its lower end engaging a plate 27 on transverse component 19' of the base frame so that manual rotary adjustment of rod 25 serves to effect an adjustment of the vertical position of the adjustable frame elements 20, 23, 24 etc. about pivot 21.

Figure 4:
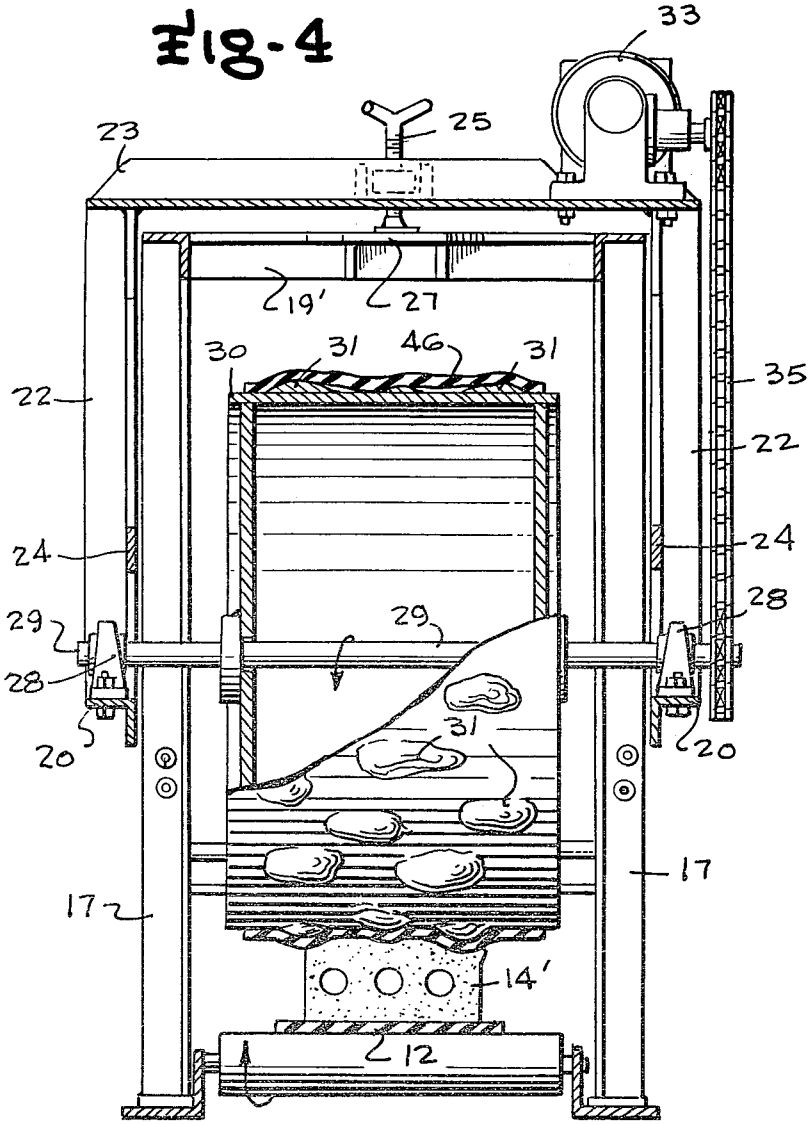
FIG. 4 is a sectional view taken along lines 4—4 of FIG. 1.
Figure 3:
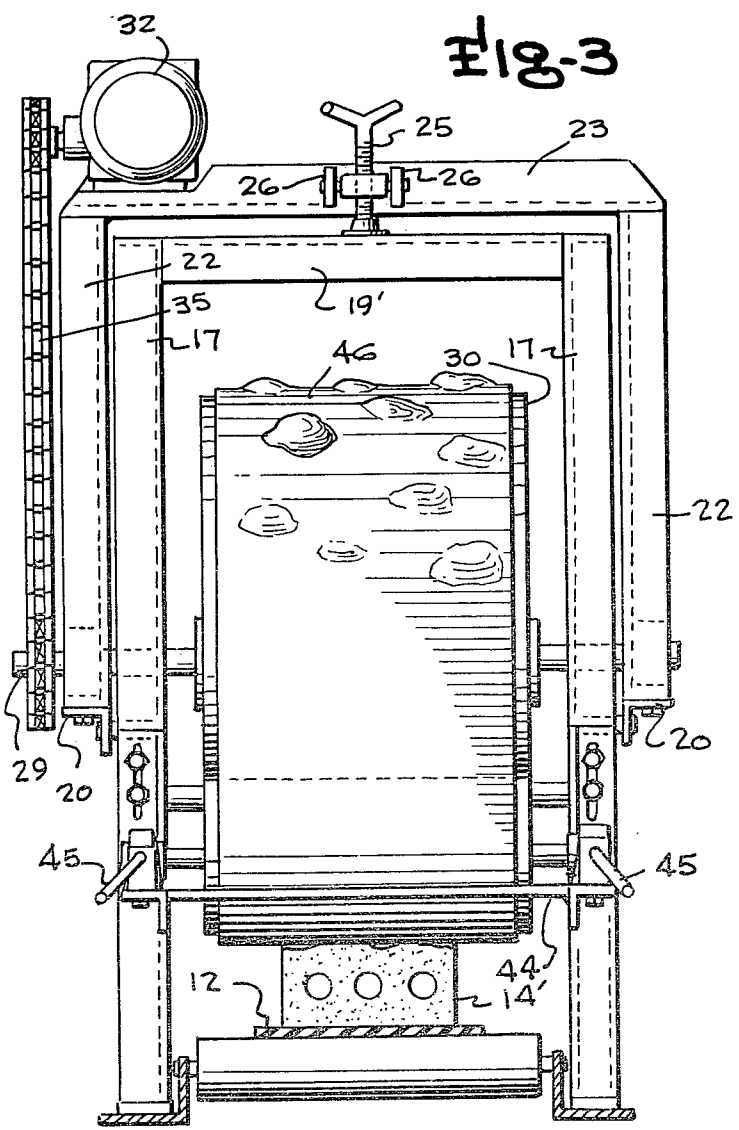
FIG. 3 is an end elevation of the preferred embodiment.

Shaft bearing means 28 best illustrated in FIG. 4 are mounted on the pivot arms 20 of the adjustable frame and provide rotary support for a shaft 29 of a relatively large cylindrical impression roller 30 which has a plurality of rounded protuberances 31 on its outer surface. A variable speed electric motor 32 is mounted on the motor support plate 23 and drives a step-down transmission 33 having an output sprocket 34 connected by a chain 35 to a sprocket 36 keyed to the end of impression roller shaft 29 so that operation of motor 32 serves to rotate impression roller 30 to rotate in the direction of arrow 30' in FIG. 1.

The upstream vertical corner post members 16 of the fixed frame provide support for bearing members 38 in which an upstream belt roller 40 is supported for rotation. Similarly, an adjustable downstream belt roller 42 is mounted on adjustable bearings 43 carried on support bracket means 44 attached to the downstream vertical corner post member 17. It will be seen that rotation of conventional adjustment cranks 45 will serve to move the bearings 43 and roller 42 in a horizontal plane in an obvious manner as shown in FIG. 1. A flexible belt loop 46 formed of elastomeric material such as rubber or the like is entrained about the upstream and downstream belt rollers 40 and 42 and about the upper surface of the impression roller 30. Belt loop 46 is maintained in tension by a floating idler roller 48 mounted in bearings attached to pivotal support frame members 50 which are mounted for pivotal movement about pivot means 52 on the upstream vertical corner post members 16 as shown in FIG. 1. The weight of floating idler roller 48 obviously serves to maintain the belt 46 in tension regardless of the position of adjustment of the downstream roller 42. Rollers 40 and 42 are of the same size and have their axes of rotation in a common horizontal plane so that a lower horizontal flight 46' of the elastomeric belt member 46 extends between the rollers 40 and 42 in parallel alignment with the conveyor belt 12.

It will be observed that the protuberances 31 of the impression roller 30 engage the flight 46' to deflect discrete portions of the flight downwardly toward the conveyor 12 as shown in FIG. 1 and FIG. 4. The deflected portions of the belt flight 46' press into the upper surfaces of the green moist brick members 14 which are being conveyed from left to right in FIG. 1 so as to distort both the upper edge of the bricks engaged by the belt flight 46' and frequently one or more of the other faces of the bricks with the exception of the lower edge resting on conveyor 12 so as to provide an irregular brick 14'. The distortion of all faces of the bricks with the exception of the face resting on conveyor 12 is effected by virtue of the fact that the substantial downward impression of the belt into the upper face of the brick results in an outward bulging of one or more of the other faces. Consequently, when the finished irregular shaped brick is used to form a wall, it presents an irregular mortar edge having the appearance of antique or handmade brick.

Not only does the horizontal belt flight 46' provide an impression into the brick, it also engages the brick both upstream and downstream of the impression roller for keeping the brick from falling over and destroying the geometric array of the brick on the conveyor member. Consequently, the downstream handling equipment of conventional design can function to remove brick from the conveyor 12 for further processing. Obviously, the motor 32 is adjusted to provide a rotational speed of the impression roller 30, which drives belt 46, so that the belt 46 is moving at the same speed as the brick conveyed by roller 12.

While the variable speed electric motor 32 is normally employed for fabricating bricks having relatively narrow edge portions resting on the conveyor 12, it is possible when fabricating other bricks having relatively large face areas resting on the conveyor to use an alternate construction by elimination or deactivation of the drive means 32 to permit the frictional engagement of the belt flight. In all other respects, the operation of the alternative embodiment in which use of the motor 32 is eliminated is identical to that of the first embodiment.

It should be understood that the size, shape and number of protuberances 31 on the roller 30 can be varied in accordance with the nature of the brick being formed. Additionally, the adjustment of the roller 30 vertically by means 25 etc. can also be varied for providing a variation in the final product. In any event, all of the brick formed by the process differ from each other due to the irregular facing of the protuberances 31 so that the brick each have an individual appearance and shape to provide a handmade or antique appearance.

Numerous modifications of the subject invention will undoubtedly occur to those of skill in the art. For example, it is not essential that a roller be used for distorting the lower flight 21 downwardly into the brick conveyance area since plungers or other similar means such as multiple rollers of smaller diameter could also be used for the same purpose. The essential ingredient of the invention is the use of means for deflecting the moving belt member downwardly to provide a brick distortion without destroying the orderly array of the bricks. Therefore, it should be understood that the spirit and scope of the invention is to be limited solely by the appended claims.

I claim:

1. Apparatus for forming brick or the like of irregular configuration having a handmade appearance comprising a brick conveyor means, means for driving said brick conveyor means at a constant speed for feeding individual raw pliable brick members along a feed path, a flexible sheet member positioned above said brick conveyor means to engage the upper surface of brick members conveyed thereon, means for supporting and moving said flexible sheet member at the same speed and in the same direction as said brick conveyor means, force applying means for applying force through discrete portions of said flexible sheet member to press said discrete portions toward said brick conveyor means against and into any brick members on the brick conveyor means to effect a permanent deformation of said brick members without changing the relative positions of said brick members on said conveyor means, wherein said flexible sheet member comprises a horizontal flight of an elastic rubber-like belt loop and said means for supporting and moving said flexible sheet member includes upstream and downstream roller members supporting said horizontal flight of said belt loop so that said horizontal flight at least partially rests on the upper surfaces of brick members on said brick conveyor means.

2. The apparatus of claim 1 wherein said force applying means includes an irregularly surfaced roller member having protrusions engaging the upper surface of said horizontal flight.

3. The apparatus of claim 2 additionally including variable speed motor means drivingly connected to said irregularly surfaced roller member for rotating same, an upper portion of said belt loop being entrained about an upper portion of said irregularly surfaced roller member so as to be driven thereby.

4. The apparatus of claim 2, wherein an upper portion of said belt loop is entrained about an upper portion of said irregularly surfaced roller member and said belt loop is driven by frictional engagement with the upper surface of said brick members on said brick conveyor means.

5. The apparatus of claim 2 additionally including adjustable support means for vertically adjusting the position of said irregularly surfaced roller member with respect to said flight.

6. The apparatus of claim 5 additionally including floating tension roller means contacting the upper portion of said belt loop for maintaining said belt loop in desired tension.

7. The apparatus of claim 3 additionally including floating tension roller means contacting the upper portion of said belt loop for maintaining said belt loop in desired tension.

* * * * *